US012440021B2

(12) United States Patent
Rhines

(10) Patent No.: US 12,440,021 B2
(45) Date of Patent: Oct. 14, 2025

(54) OPEN MULTI-FUNCTIONAL DESK UNIT

(71) Applicant: Michael Jerome Rhines, Orange, TX (US)

(72) Inventor: Michael Jerome Rhines, Orange, TX (US)

( * ) Notice: Subject to any disclaimer, the term of this patent is extended or adjusted under 35 U.S.C. 154(b) by 0 days.

(21) Appl. No.: 18/231,593

(22) Filed: Aug. 8, 2023

(65) Prior Publication Data

US 2024/0237816 A1 Jul. 18, 2024

Related U.S. Application Data

(63) Continuation-in-part of application No. 17/667,526, filed on Feb. 8, 2022, now abandoned.

(51) Int. Cl.
*A47B 17/00* (2006.01)
*A47B 13/00* (2006.01)

(52) U.S. Cl.
CPC ..... *A47B 17/00* (2013.01); *A47B 13/00* (2013.01); *A47B 2220/0002* (2013.01); *A47B 2220/0075* (2013.01)

(58) Field of Classification Search
CPC ..... A47B 67/005; A47B 5/06; A47B 21/02; A47B 83/405; A47B 2200/0036; A47B 39/02; A47B 39/00; E04B 1/34357; E04B 1/34321; E04B 1/8218; E04B 1/34352; E04H 1/1272; E04H 1/12; E04H 1/125
USPC ..... 312/224–227, 223.3; 108/50.01, 50.02; 52/36.1
See application file for complete search history.

(56) References Cited

U.S. PATENT DOCUMENTS 560,266 A * 5/1896 Henrick
1,008,754 A * 11/1911 Thompson ..... A47B 67/005 312/249.7
1,014,853 A * 1/1912 Russell ..... A45C 5/00 144/285
1,284,492 A * 11/1918 Thomas ..... F21V 33/00 49/70
1,341,106 A * 5/1920 Booth ..... A47B 61/00 312/227
1,430,465 A * 9/1922 Niemuth ..... A47B 39/12 312/196
1,721,097 A * 7/1929 Tomlins ..... A47B 39/02 248/188.1
1,749,686 A * 3/1930 Agazzi ..... A47B 49/00 190/13 F
1,764,229 A * 6/1930 Smith ..... A47B 67/005 312/238

(Continued)

FOREIGN PATENT DOCUMENTS

CN 102341521 A * 2/2012 ..... C21D 8/02
CN 102351094 A * 2/2012

(Continued)

*Primary Examiner* — Janet M Wilkens
(74) *Attorney, Agent, or Firm* — Delphine James

(57) ABSTRACT

A multipurpose furniture comprising a front desk portion and a back desk portion that is connected by an adjustable guard rail. The front desk portion includes a front mirror with opposing rotatable side mirrors. The rotatable side mirrors allow for 360 view of your image while sitting between the two desk. A foldable laptop desk is operationally connected to the front desk portion. The back desk portion includes a top mirror, shaving mirror and a plurality of hooks.

19 Claims, 12 Drawing Sheets

(56) References Cited

U.S. PATENT DOCUMENTS

| | | | | | |
|---|---|---|---|---|---|
| 3,533,671 | A * | 10/1970 | Huber | F21V 33/00 | 312/227 |
| 4,460,246 | A * | 7/1984 | Peel | A47G 1/04 | 312/226 |
| 4,925,285 | A * | 5/1990 | Dowdell | A61B 5/103 | 359/860 |
| 9,022,414 | B2 * | 5/2015 | Bell | A47F 5/108 | 280/30 |
| 10,174,515 | B1 * | 1/2019 | Krivens | A47B 83/02 | |
| 11,274,463 | B2 * | 3/2022 | Tsuto | E04H 1/125 | |
| 2009/0145050 | A1 * | 6/2009 | Dugand | A47B 47/0041 | 52/36.2 |
| 2019/0119902 | A1 * | 4/2019 | Chen | E04B 1/8218 | |
| 2020/0018060 | A1 * | 1/2020 | Watanabe | E04B 1/388 | |
| 2022/0248842 | A1 * | 8/2022 | Rhimes | A47B 21/02 | |

FOREIGN PATENT DOCUMENTS

| | | | | | |
|---|---|---|---|---|---|
| CN | 109043846 | A | * | 12/2018 | |
| CN | 109057406 | A | * | 12/2018 | |
| EP | 2468145 | A1 | * | 6/2012 | A47B 39/00 |
| JP | 2017181133 | A | * | 10/2017 | |
| SU | 511495 | A | * | 8/1976 | |
| SU | 1008608 | A | * | 3/1983 | |

* cited by examiner

OPEN MULTI-FUNCTIONAL DESK UNIT

BACKGROUND OF THE INVENTION

This application claims the benefit of patent application Ser. No. 17/667,529

The present invention relates to furniture. More specifically the present invention relates to multipurpose or multifunctional furniture.

People have used furniture since the beginning of civilization. Furniture is used to support human activities. The cost of buying furniture is a major financial burden for many families. Additionally, the cost of purchasing a home or leasing an apartment has significantly increased over the years which may result in a limited amount of space. Thus; people are looking for various ways to accommodate space but, yet be fashionable.

With the increase in population and the high cost of purchasing homes and leasing apartments, multifunctional furniture has become more popular. Unique and modern designed multipurpose furniture has been gaining popularity. Multipurpose furniture provides a design that incorporates pieces that can be used for more than one purpose.

Multifunctional furniture is a broad category of products that includes wall beds, transforming tables, compact seating, or innovative storage solutions. Queen, twin and bunk wall beds with integrated sofas, desks, shelving and tables that allow one piece of furniture to do double-duty and maximize every square foot. This patent provides a novel design for a multifunctional makeup desk.

SUMMARY OF THE INVENTION

One objective of the present invention is to provide a cost-effective, durable, and capable of performing more than one function.

Another objective of the present invention is to provide furniture that is selectively multifunctional configurable.

Another objective of the present invention is to provide conserve space.

The present invention discloses a multipurpose furniture comprising a front desk portion and a back desk portion that are separated. The front desk portion includes a front mirror with opposing rotatable side mirrors. The rotatable side mirrors allow for 360 view of your image while sitting between the two desk. A foldable laptop desk is operationally connected to the front desk portion. The back desk portion includes a top mirror, shaving mirror and a plurality of hooks.

The above and other objects, features and advantages of the present invention should become even more readily apparent to those skilled in the art upon a read in of the following detailed description in conjunction with the drawings wherein there is shown and described illustrative embodiments of the invention.

BRIEF DESCRIPTION OF DRAWINGS

These and other details of the present invention will be described in connection with the accompanying drawings, which are furnished only by way of illustration and not in limitation of the invention.

DETAILED DESCRIPTION OF THE INVENTION

Figure 2:
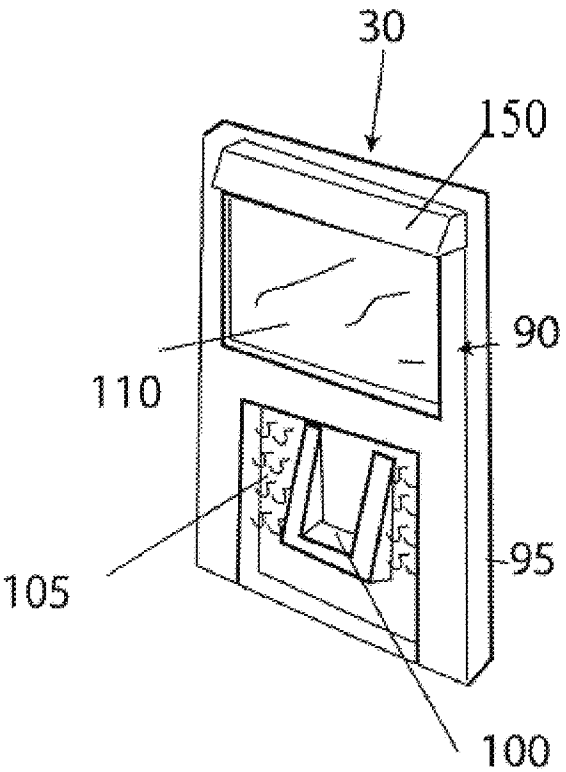
FIG. 2 is a cutaway frontal perspective view of the back desk unit.

FIGS. 8-12 depict an exampere embodiment of a furniture item according to the present invention, an opened multi-functional make-up desk (10). The present invention comprises a front desk unit (20) apposite a back desk unit (35) connected by a guard rail (85). Even desk unit (20, 30) is configured to be asynchronously adjustable to a desired length along the guard rail (85). The open seating configuration can be implemented with side panels as disclosed in FIGS. 8-12 or beams as disclosed in FIG. 1.

In the illustrated embodiment each desk (20, 30) has a connector member (200, 210) which slidably receives the guard rail (85). In use, each desk unit (20, 30) can be moved asynchronously along the guard rail (85) to a desired position. At the desired point a stopper (205, 206) can be placed in front of the each connector member (200, 201) to prevent further movement along guard rail (85). The stopper can be integrated with each connector member or can be a separate component.

Figure 11:
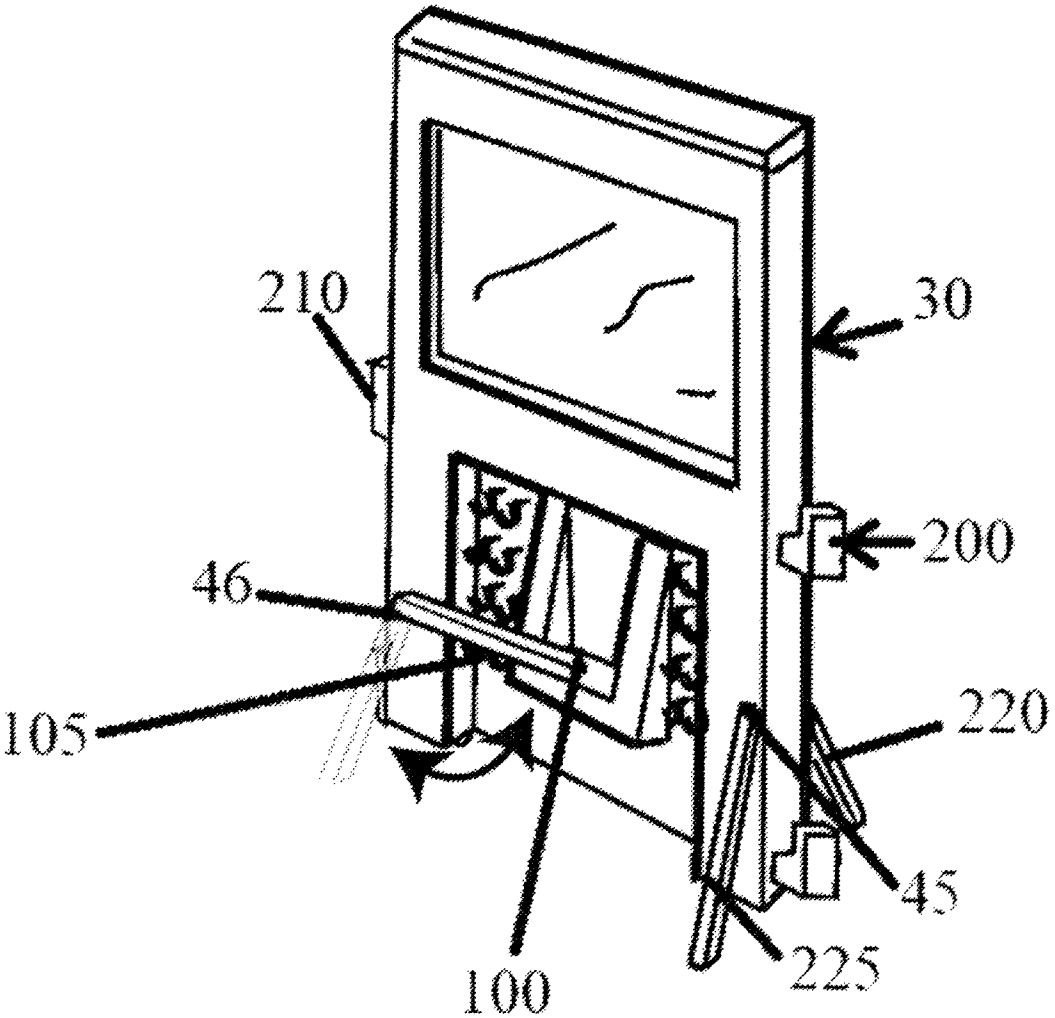
FIG. 11 is a perspective view of back desk unit with kick stands
Figure 12:
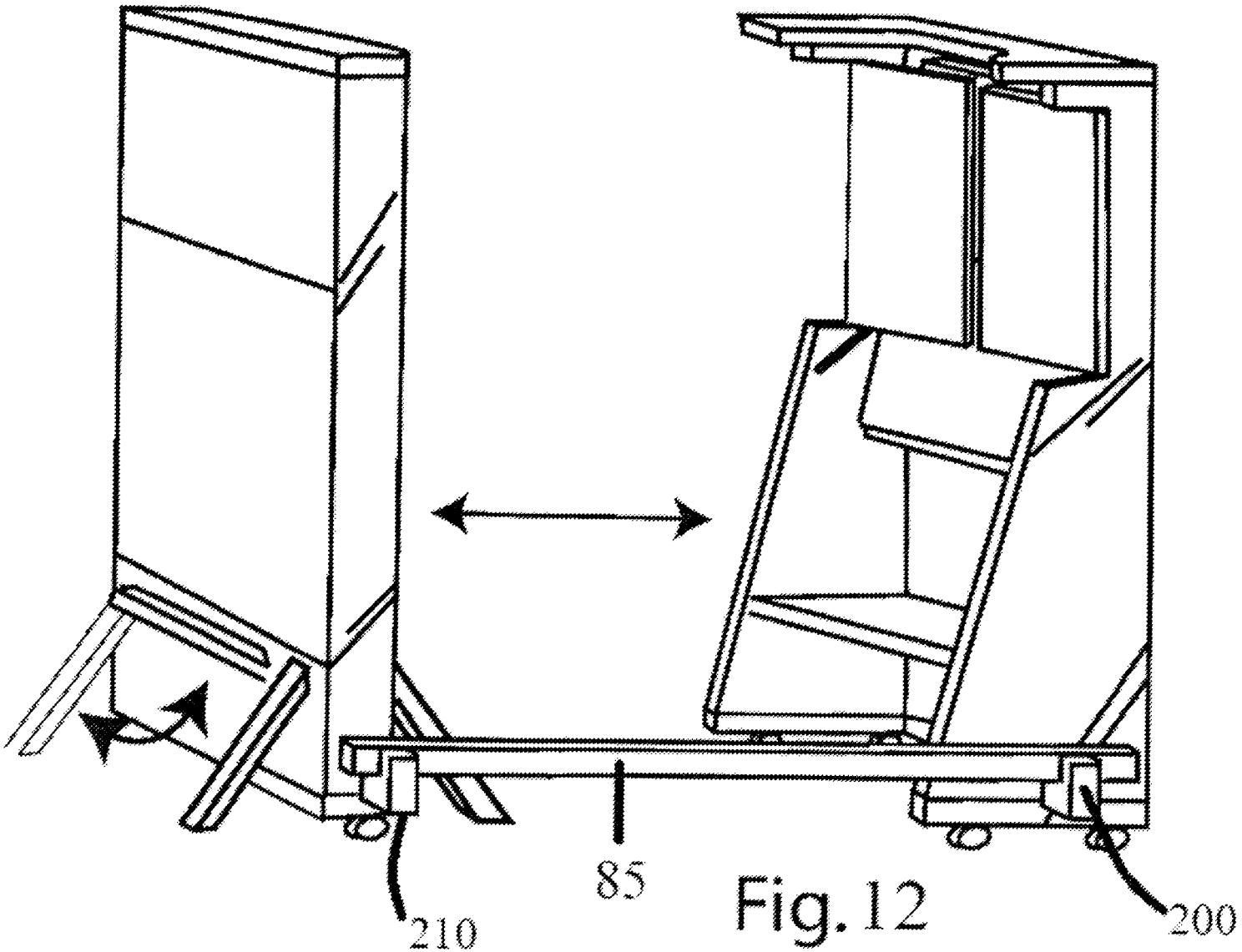
FIG. 12 is a perspective view of the stand-alone back desk unit and front desk unit connected with adjustable guard rail.

As depicted FIGS. 11 and 12 each back or front desk unit can be supported by one or more kickstands (225). Each kickstand can be configured to pivot upward and downward to support each front and/or back desk unit. As depicted the kickstands can extend to the supporting platform or extend directly to the floor.

Figure 1:
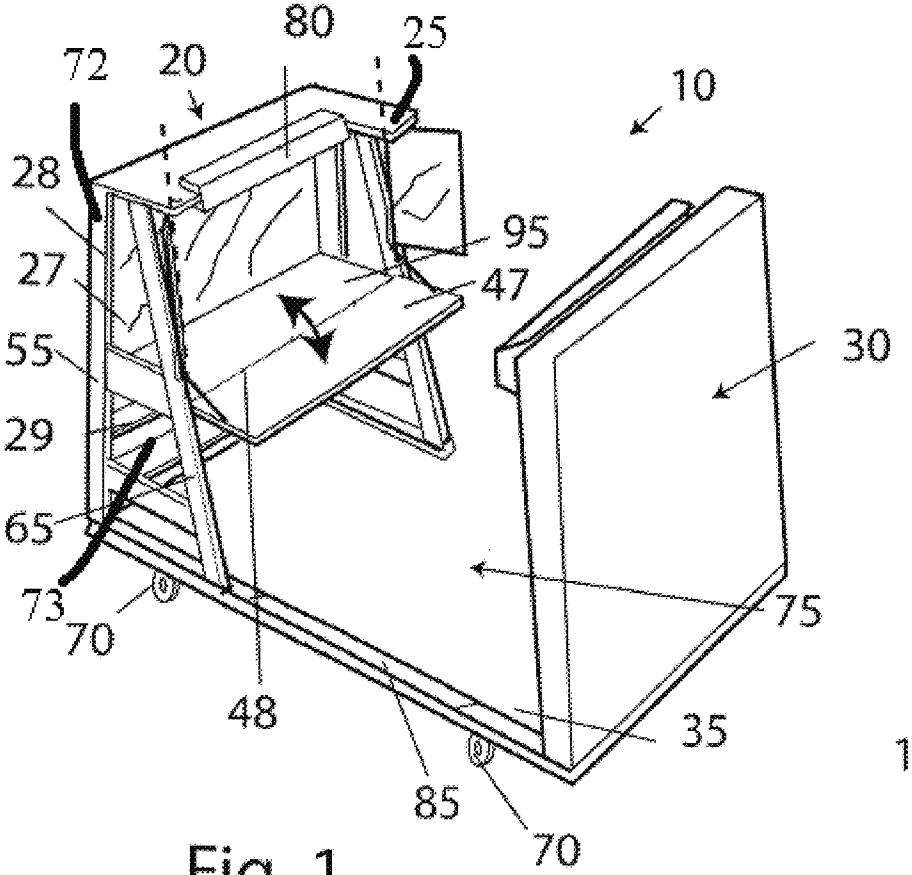
FIG. 1 and FIG. 1*c* are a perspective views of one embodiment of the present invention, an open multi-functional makeup desk.
Figure 3:
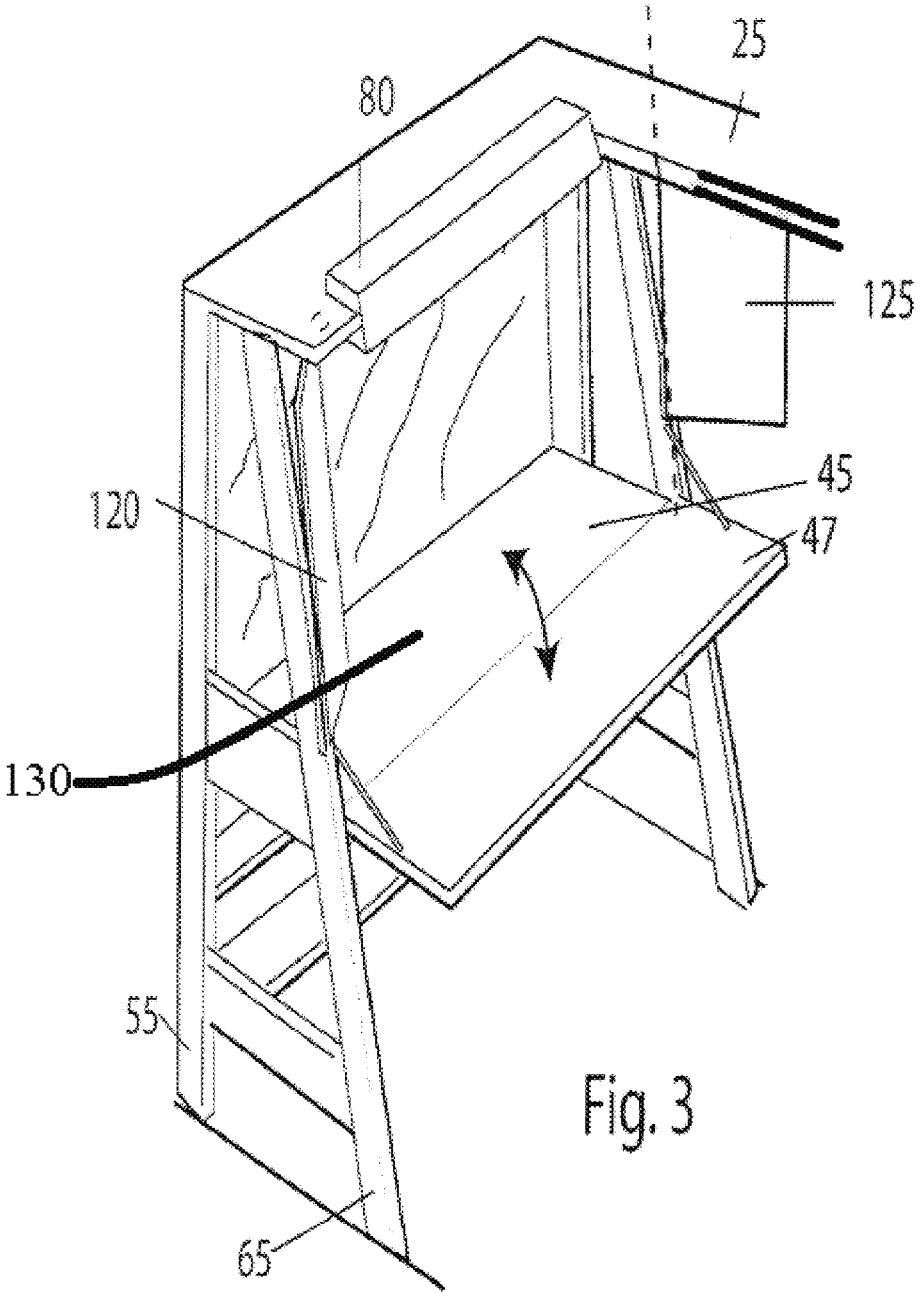
FIG. 3 is cutaway frontal perspective view of the front desk unit.
Figure 4:
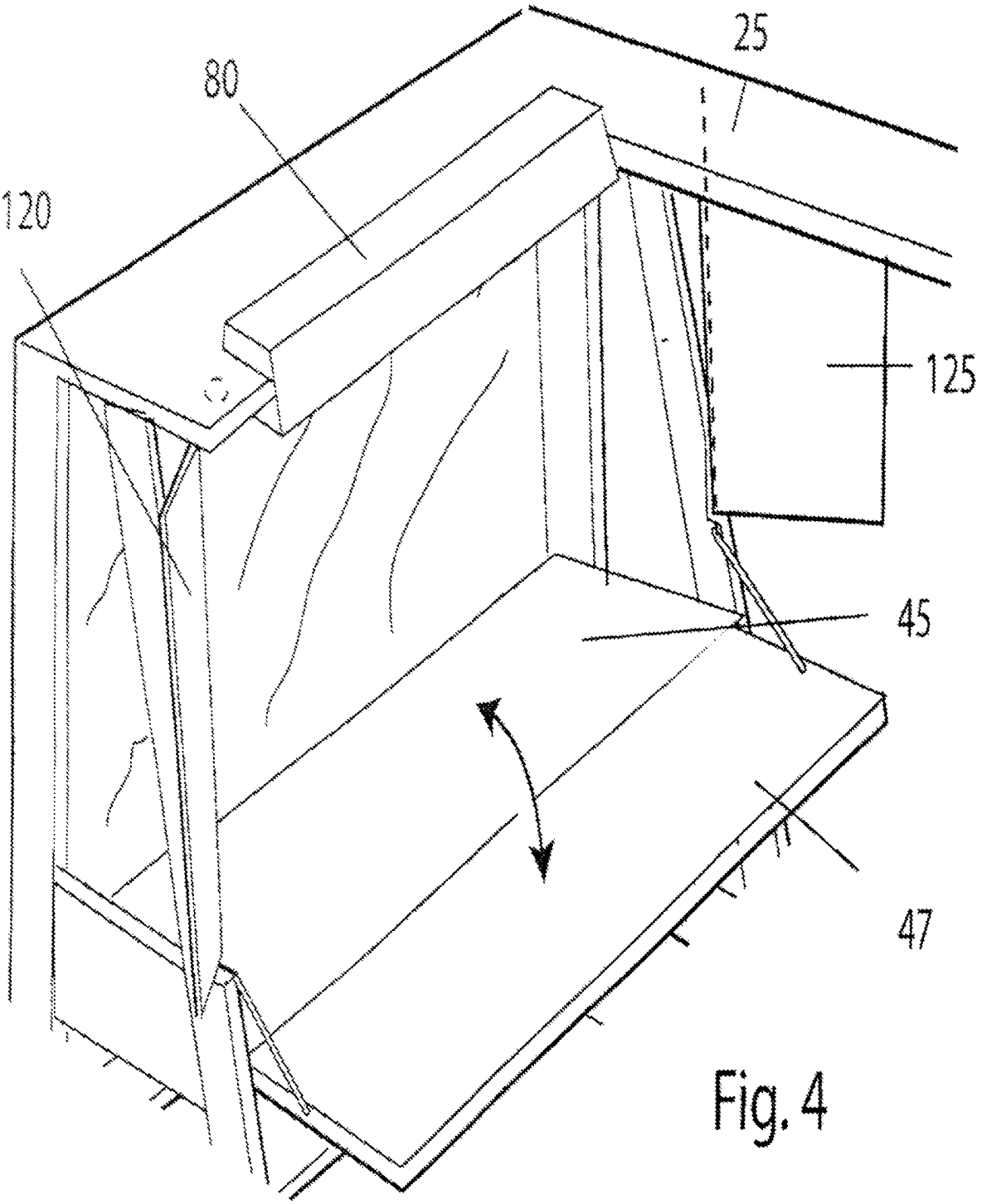
FIG. 4 is a cutaway frontal perspective view of the upper compartment of the front desk unit.

Referring to FIGS. 1 and 3 there is shown a front perspective view of the present invention. As depicted, the front desk unit (20) includes a front upper portion (27) and a front lower portion (29). The front upper portion (28) forms an upper compartment for receiving a front mirror (27) which is disposed atop a rear shelving unit (45) extending laterally outward in a horizontal orientation a terminal peripheral edge (48) that is hingedly connection to a front shelving unit (47). In the depicted embodiment, the front shelving unit (47) transitions between an upward and lower position. The front upper portion (28) of the front desk unit (20) further includes a backwall upon with the front mirror (27) is mounted.

Alternatively, the front shelving unit (47) can pivot forward to overlay the topside of the rear shelving unit (45). As depicted the rear shelving unit (45) has a pre-determine width and length equivalent to the upper compartment. However, the front shelving unit (47) has a length that is equivalent to the rear shelving unit (45), but the width can vary to the width of the rear shelving unit (45).

Figure 5:
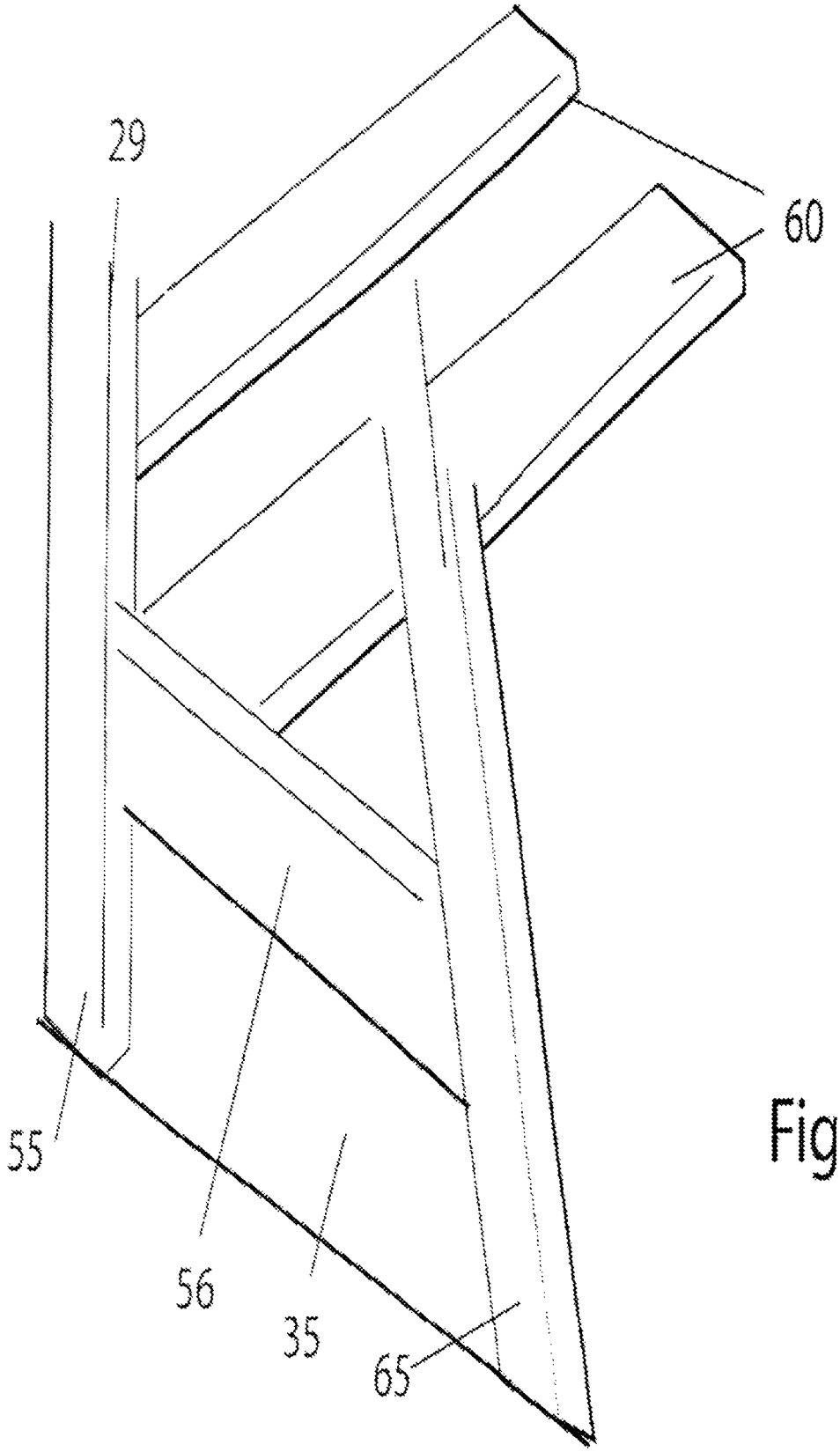
FIG. 5 is a cutaway frontal perspective view of the upper compartment of the front desk unit
Figure 6:
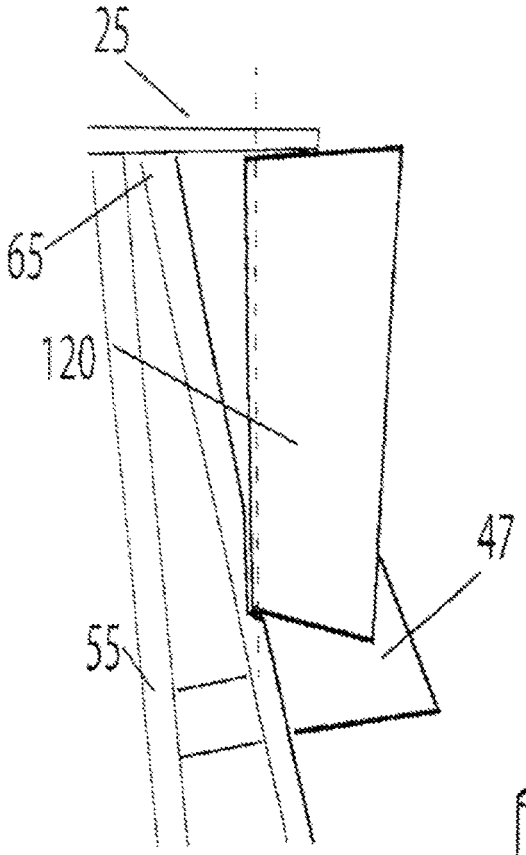
FIG. 6 is a cutaway view of one of the dual mirror located within the upper compartment of the front desk unit.
Figure 7:
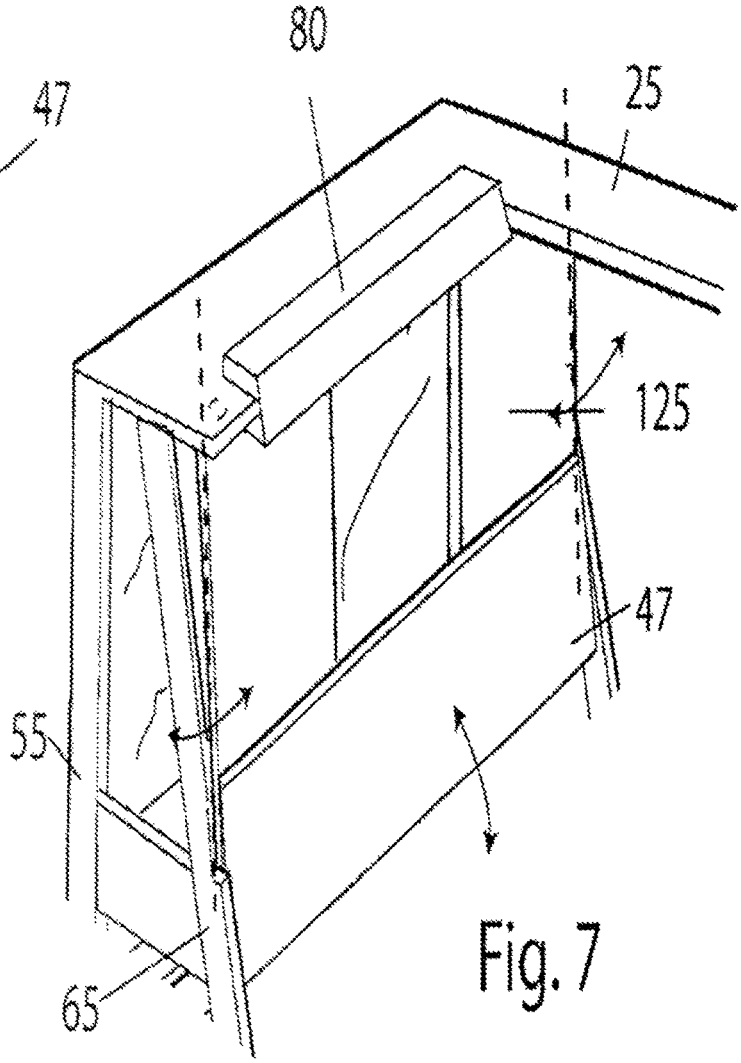
FIG. 7 is a cutaway view of one of the upper compartment of the front desk unit with the shelve unit in the up position.
Figure 8:
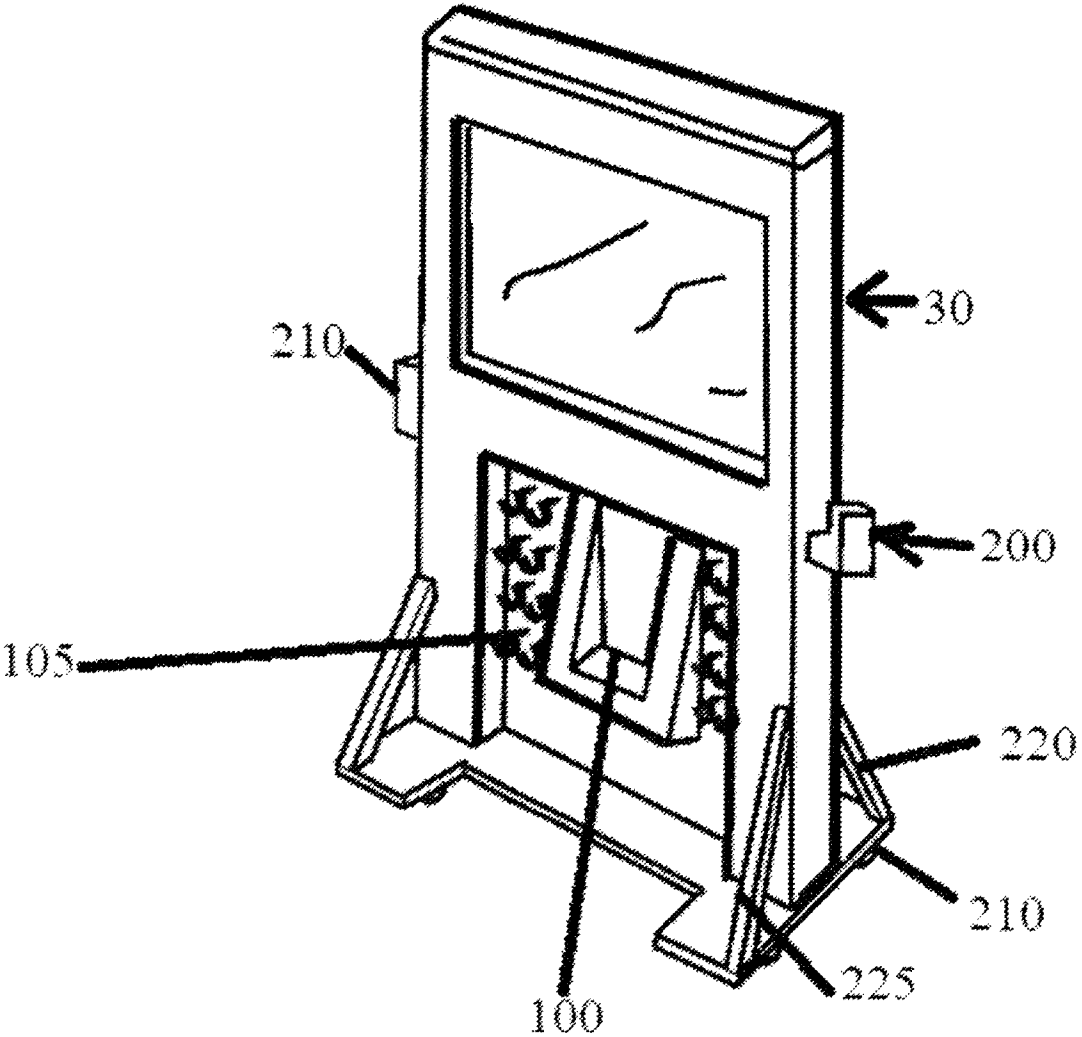
FIG. 8 is a perspective view of the stand-alone back desk unit
Figures 9, 10:
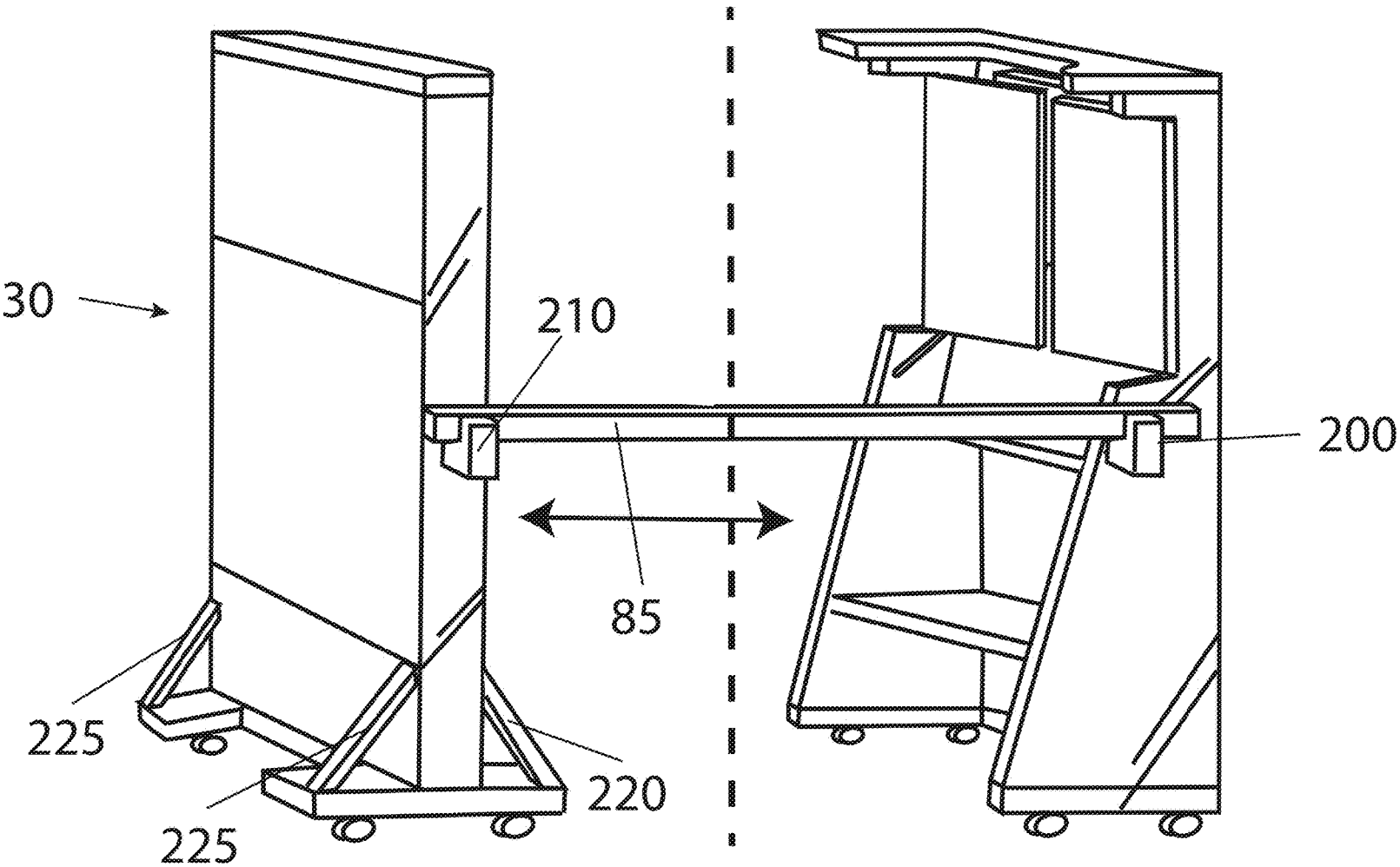
FIG. 9 is a perspective view of the stand-alone back desk unit.
FIG. 10 is a perspective view of the front desk unit.

As depicted in FIG. 5, the front lower portion (29) forms a front lower compartment for receiving one or more lower shelving units (60) with each protruding outward in a horizontal orientation. Each lower shelving unit (60) has a pre-determine width and pre-determine length equivalent to the width and the length of the front lower compartment (29).

Multipurpose desk (10) further includes a leg arrangement that is operationally attached to the underside of each separate desk unit (30, 20). The leg arrangement (70) can include a plurality of legs arranged to support the entire multipurpose desk (10) thereby providing balance. The leg arrangement (70) can have stationary legs or rotatable legs for easy movement. The leg arrangement (70) can be mounted at each corner or alternatively balanced in the center. Casters can be mounted upon the rotatable legs to prevent movement when placed in a specific position.

Multipurpose desk (10) can include an opened seating area (75) that is disposed between the front desk unit (20) and the back desk unit (30). The multipurpose desk (10) can be made of wood, metal, plastic, sturdy composite material, or another suitable sturdy material. The back upper portion (90) of the back desk unit (30) further includes a backwall upon with the back mirror is mounted. The opened seating area is created by the distance between the front desk unit (20) and the back desk unit (30).

Figure 1A:
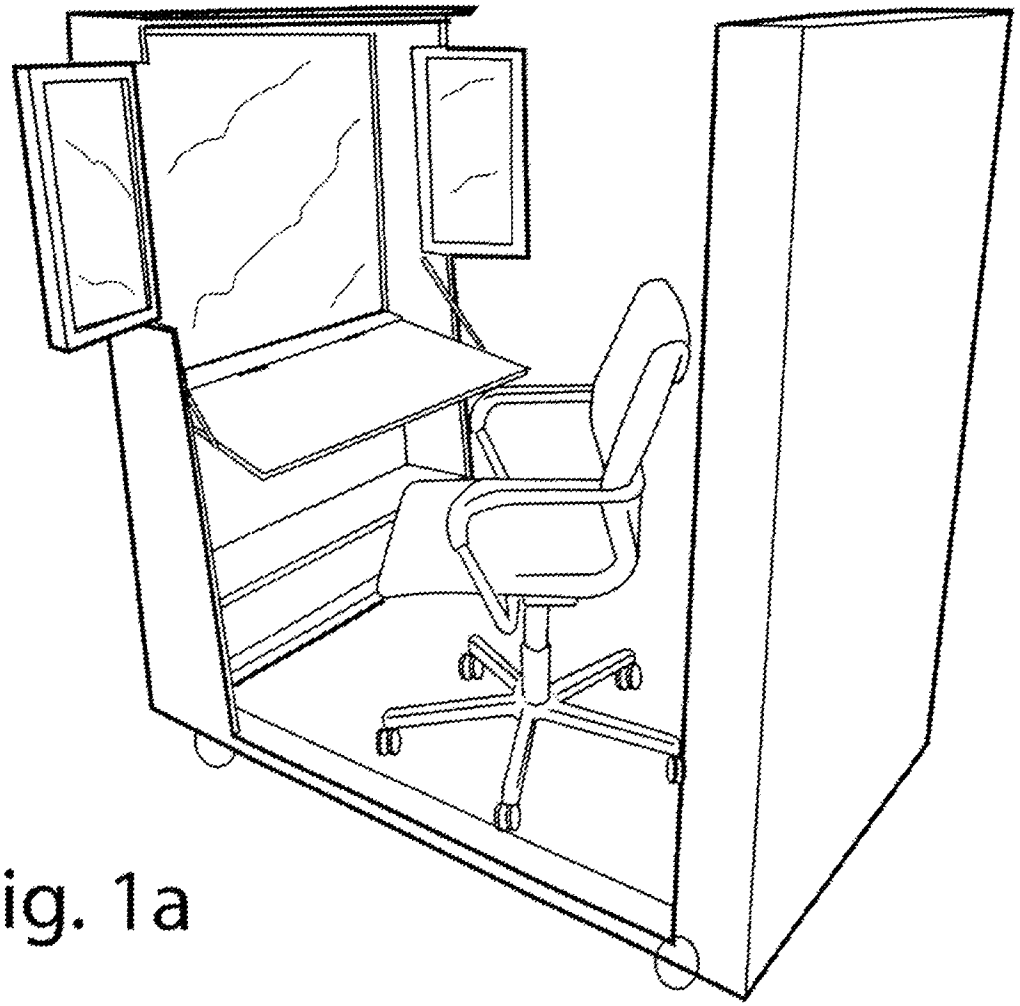
FIG. 1*a* is a perspective view of one embodiment of the present invention with a chair in the opened area, multi-functional makeup desk.
Figure 1B:
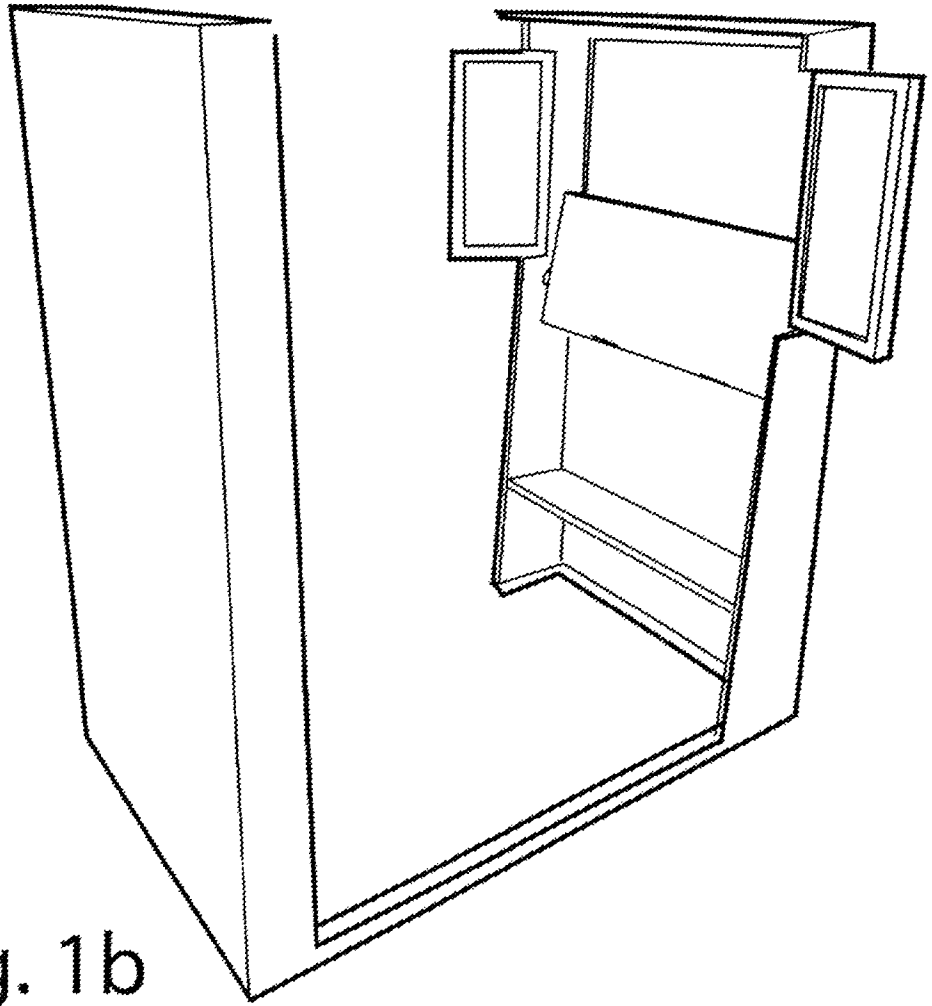
FIG. 1*b* is a perspective view of another embodiment of the present invention, multi-functional makeup desk.
Figure 1C:
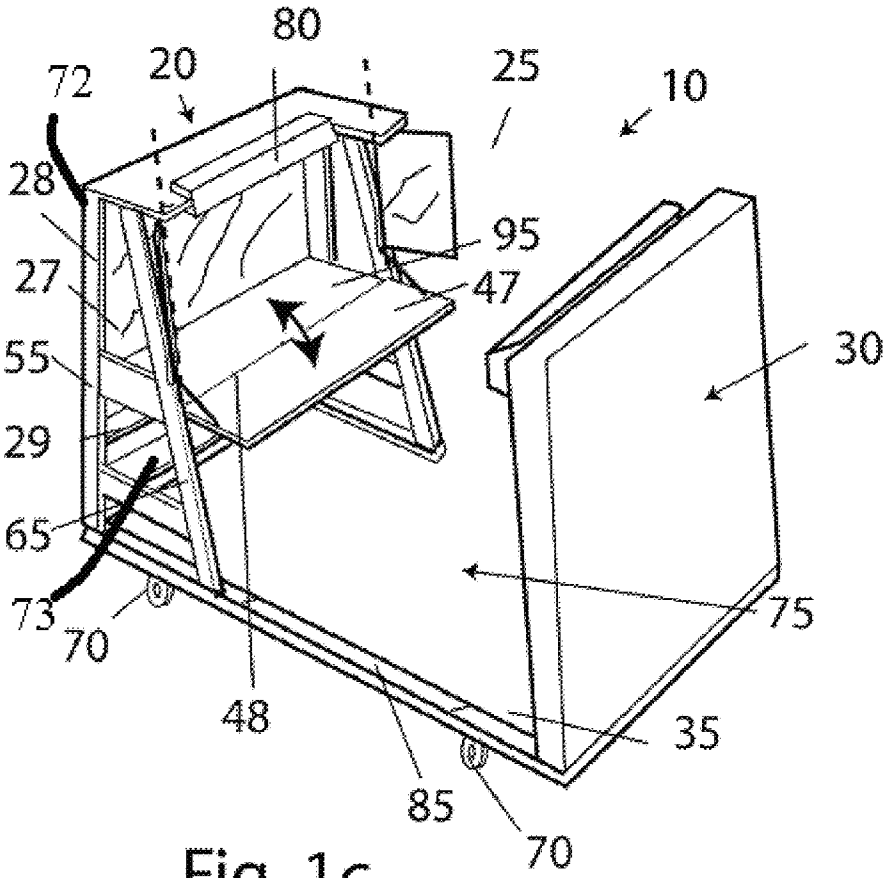

Depicted in FIG. 1C is one embodiment of the present invention. As depicted, disposed on opposing sides of the upper portion (28) of the front desk unit (20) is a pair of vertical beams (55) and a pair of tapering beams (65). Each vertical beam (55) and tapering beams (55) extend from the underside of the top platform (25) to the top side of the bottom platform (35). The pair of tapering beams (65) extend diagonally downward from the underside of the top platform at preferably a 45 degrees angle which provides an increase in the opened seating area (75). The tapering beams (65) angle of descent can be varied to increase or decrease the opened seating area (75). As depicted, each of the tapering beams (65) lye adjacent and in front of the vertical beams (65). Each tapering beam (65) is connected to each vertical beam (55) by one or more lateral supporting beams (56).

FIGS. 1A and 1B illustrates another embodiment of the present invention. In this alternative embodiment the sides of the desk unit (10) are not beams but solid tapered walls mounted upon opposite sides of the desk unit (10).

Dual mirrors (120, 125) can be mounted within the front upper compartment. Each mirror (120, 125) is pivotally or rotatably mounted between the underside of the top front platform (25) extending to a cutout (130) within the tapered beams (65) directly above the hinged connection of the rear shelving unit (47). As depicted a bolt can be installed at the top and bottom of the mirror to allow for pivoting. Additionally, a rotatable ball connection can be installed at the top and bottom of the mirror to allow for rotating. As a user sits within the seating area (75), the dual mirrors (120, 125) can be individually pivoted or rotated to allow view of the back image from the back mirror.

In FIGS. 1*a* and 1*b* shelf (73) is hingedly connected to the backwall. As further depicted in FIGS. 1*a* and 1*b*, opposing sidewalls (72) extend linearly downward from mirror (120) to the lower platform (35). Additionally, the upper portion of 72 is tapered.

As depicted a front lighting fixture (80) can be mounted in front of the upper compartment (28) within the top platform (25) directly above the rear shelving unit (45). A lighting fixture (150) can be mounted on the front of the back desk unit or on one or both sides of the back upper compartment. Also, a lighting fixture can be mounted on one or both sides of the front upper compartment. The lighting fixture can be Light emitting diodes (LEDs) or another suitable lighting fixture. Additionally, guide rails (85) can be mounted on one or both sides of the of the top side of the bottom platform (35). Each guard rail (85) is a shaft that extends at least the length of the opened seating area (75) thereby retaining a chair (not shown) therein. The guard rail (85) can disposed at the lower end or at the middle of the open seating area.

As depicted a front lighting fixture (80) can be mounted in front of the upper compartment (28) within the top platform (25) directly above the rear shelving unit (45). A lighting fixture can be mounted on the front of the back desk unit or on one or both sides of the back upper compartment. Also, a lighting fixture can be mounted on one or both sides of the front upper compartment. The lighting fixture can be Light emitting diodes (LEDs) or another suitable lighting fixture. Additionally, guide rails (85) can be mounted on one or both sides of the of the top side of the bottom platform (35). Each guard rail (85) is a shaft that extends at least the length of the opened seating area (75) thereby retaining a chair (not shown) therein.

Referring to FIG. 2 there is shown a front perspective view of the back desk unit (30) of the present invention. As depicted, the back desk unit (30) includes a back upper portion (90) and a back lower portion (95). The back upper portion (90) forms a back upper compartment for receiving a back mirror (110) which has substantially equivalent dimension to the front mirror (27). The back mirror (110) is mounted within the back upper compartment at the same line of sight with the front mirror (27).

The back lower portion (95) comprises a shaving mirror (100) which is mounted at preferably a 45 degrees angle; however, the angle of the shaving mirror (100) can vary. Surrounding the shaving mirror (100) is a plurality if hooks (105). As depicted a back lighting fixture (120) can be mounted in front of the back upper compartment (90) within the top platform (25) directly above the back mirror (110).

Below is the preferred dimension of the present invention; however the dimensions can be customized to support the user.

The front and back mirror are approximately 22 inches by 22 inches. The back mirror can have smaller dimensions than the back mirror. The back upper portion (90) of the back desk unit (30) further includes a backwall upon with the back mirror is mounted.

The vertical beams are approximately 53⅝ inches long.

The tapering beams are approximately 57 inches long.

The bottom panel in FIGS. 1A and B tapers similar to the tapering beams.

The top and bottom platforms are 29¼ inches wide by 4 feet long with ¾ inches thick.

The shaving mirror is 6% inches wide by 8½ inches long at a 45 degree angle.

What is claimed is:

1. An opened multi-functional desk unit, the desk unit comprising: a front desk unit apposite a back desk unit that are connected by a guard rail; the front desk unit and the back desk unit each supported by a lower platform; the front desk unit includes a front upper portion and a front lower portion; the front upper portion forms an upper compartment with a front upper back wall having a front mirror mounted thereto; a first pair of sidewalls perpendicularly attached to a pair of opposing side edges of the front desk unit; the first pair of sidewalls tapered upwardly from the lower platform;

the back desk unit is defined by a back upper portion and a back lower portion; the back upper portion form a back upper compartment having a back upper wall with a back mirror mounted thereto; an opened seating area that is disposed between the front desk unit and the back desk unit; and the back mirror is mounted within the back upper compartment at the same line of sight with the front mirror wherein a user sitting within the open area can see 360 degrees images between the front mirror and back mirror.

2. The desk unit of claim 1 wherein the front lower portion receives one or more lateral shelves securely mounted therein.

3. The desk unit of claim 1 wherein the front upper portion has one or more light fixture operationally mounted therein.

4. The desk unit of claim 1 wherein the underside of each lower platform of the front and back desk unit has one or more wheels operationally mounted thereon thereby allowing the desk unit to be movable to various locations.

5. The desk unit of claim 1 further comprises a leg arrangement operationally mounted to the underside of the lower platform of the front and back desk unit.

6. The desk unit of claim 5 wherein the leg arrangement has stationary legs.

7. The desk unit of claim 5 wherein the leg arrangement has rotatable legs for easy movement.

8. The desk unit of claim 1 further comprising:

a pair of opposing connector members attached to a side of the front desk unit and the back desk unit;

opposing sides of the guard rail operationally mounted within the pair of opposing connector members wherein a chair can be retained within the opened seating therein the guard rail is slidably engaged within the pair of opposing connector members.

9. The desk unit of claim 8 wherein the guard rail is mounted at a mid-section on an opposing side of the front and back desk unit thereby retaining a chair within the opened seating area therein.

10. The desk unit claim 1 wherein the back upper portion of the back desk unit has one or more lighting fixtures operationally mounted therein.

11. The desk unit of claim 1 wherein the front desk unit has a first side mirror pivotally mounted in front of one side of the upper compartment.

12. The desk unit of claim 1 wherein the front desk unit has an opposing side mirror pivotally mounted in front of the opposing side of the upper compartment.

13. The desk unit of claim 1 wherein the front desk unit further comprises a shelving unit extending laterally outward and is connected to the front upper back wall below the front mirror; has an inner upper shelf perpendicularly mounted below the front mirror abutting the back edge of the upper back wall and laterally extending outward.

14. The desk unit of claim 13 wherein the shelving unit further comprises a first hinged connection to the front upper back wall and a second hinged connection at an outer peripheral edge attaching the shelving unit to a second shelving unit the front desk unit has an outer upper shelf hingedly connected to an outer peripheral edge of the inner upper shelf thereby allowing the outer upper shelf shelving unit and the second shelving unit to be pivoted from an opened and closed position.

15. The desk unit of claim 13 wherein the shelving unit extends laterally outward and is hingedly connected to a rear shelf unit below the front mirror.

16. The desk unit of claim 1 further comprising:

one or more kickstands mounted to a lower end of a back wall of front and back desk unit.

17. The desk unit of claim 1 wherein the back lower portion further comprises a shaving mirror mounted therein to a back lower wall of the back lower portion.

18. The desk unit of claim 17 wherein the back lower portion further comprises a plurality of hooks on opposite sides of the shaving mirror to the back wall of the back lower portion.

19. A disconnected front desk unit apposite a back desk unit, each unit securely connected to a top side of a lower platform; the front desk unit and the back desk unit connected by a guard rail;

the front desk unit includes a front upper portion and a front lower portion;

the front upper portion forms an upper compartment with a front upper back wall having a front mirror mounted thereto; a first pair of beams perpendicularly attached to a pair of opposing side edges of the front desk unit a second pair of beams disposed a pre-determined distance from the first pair of beams and tapered upwardly from the lower platform;

the back desk unit is defined by a back upper portion and a back lower portion; the back upper portion forms a back upper compartment having a back upper wall with a back mirror mounted thereto; the back upper portion forms a back upper compartment for receiving a back mirror; an opened seating area that is disposed between the front desk unit and the back desk unit; and the back mirror is mounted within the back upper compartment at the same line of sight with the front mirror wherein a user sitting within the open area can see 360 degrees images between the front mirror and back mirror.

* * * * *